United States Patent [19]

Porle et al.

[11] Patent Number: 4,764,188

[45] Date of Patent: Aug. 16, 1988

[54] ELECTROSTATIC PRECIPITATOR

[75] Inventors: Erik Porle; Anders Persson, both of Väkjö , Sweden

[73] Assignee: Fläkt AB, Nacka, Sweden

[21] Appl. No.: 27,394

[22] Filed: Mar. 18, 1987

[30] Foreign Application Priority Data

Mar. 19, 1986 [SE] Sweden ..... 86 01289

[51] Int. Cl.[4] ..... B03C 3/47

[52] U.S. Cl. ..... 55/130; 55/137; 55/143; 55/145; 55/154

[58] Field of Search ..... 55/130, 137, 140, 141, 55/143, 145, 154, 156

[56] References Cited

U.S. PATENT DOCUMENTS

| | | | |
|---|---|---|---|
| 2,395,927 | 3/1946 | White | 55/130 |
| 2,704,135 | 3/1955 | Marriott et al. | 55/154 X |
| 2,853,150 | 9/1958 | Lenehan | 55/156 X |
| 2,936,850 | 5/1960 | Gustafsson | 55/130 |
| 3,740,925 | 6/1973 | Gothard | 55/141 X |
| 4,155,792 | 5/1979 | Gelhaar et al. | 55/156 X |
| 4,441,897 | 4/1984 | Young et al. | 55/156 X |

FOREIGN PATENT DOCUMENTS

| | | | |
|---|---|---|---|
| 1204 | 2/1932 | Australia | 55/140 |
| 701416 | 1/1941 | Fed. Rep. of Germany | 55/130 |

*Primary Examiner*—Kathleen J. Prunner

*Attorney, Agent, or Firm*—Burns, Doane, Swecker & Mathis

[57] ABSTRACT

The present invention relates to an electrostatic precipitator (2) which comprises mutually adjacent discharge electrodes (3*a*) and collecting electrodes (4*a*), and a voltage source which delivers to the electrodes a d.c. current of high voltage so as to generate in the space (5) between the electrodes an electrostatic field which imparts an electrical charge to the solid particles and/or liquid droplets entering the space (5), such that the particles/droplets are attracted primarily to the collecting electrodes (4*a*). A plurality of electrodes are formed and positioned in a manner to provide a self-supporting structure which is flexurally rigid in all directions. The electrodes are positioned with the aid of beams (20, 21, 22) to define the aforementioned space (5), together with wall sections (2*a*, 16).

6 Claims, 3 Drawing Sheets

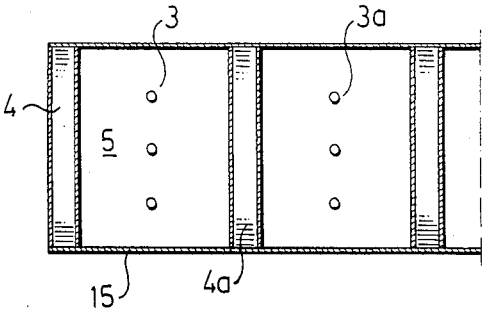
Fig 2
Fig. 3
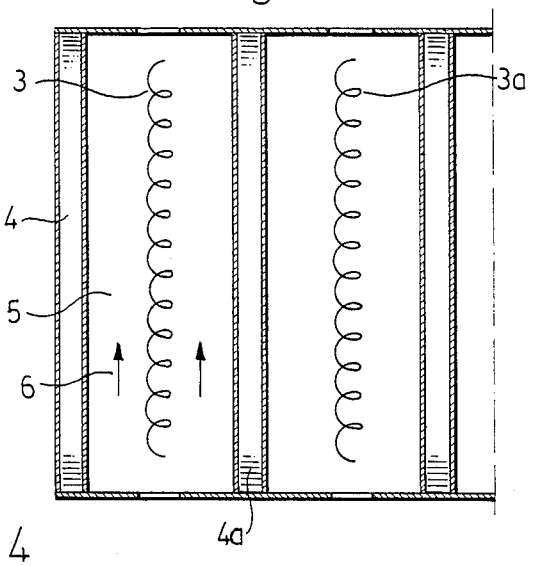
Fig. 4
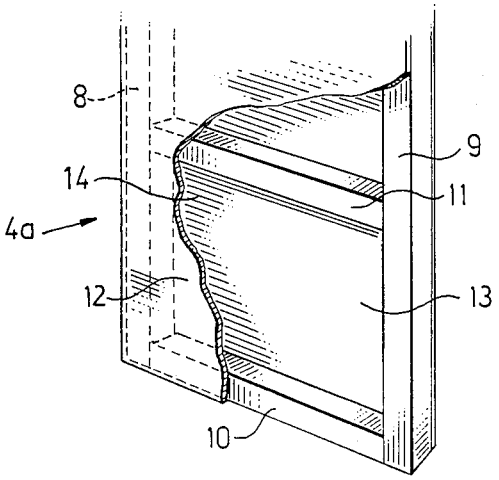

ELECTROSTATIC PRECIPITATOR

TECHNICAL FIELD

The present invention relates to an electrostatic precipitator of the kind which includes a plurality of discharge electrodes and a plurality of collecting electrodes which are positioned adjacent one another and which are supplied with a direct current of high voltage from a voltage source connected thereto, so as to generate an electrostatic field in the space between the electrodes. Gasborne dust particles and/or droplets of liquid entering the electrode interspaces are charged electrically by the electrostatic field, so that said particles and/or droplets will be attracted to the collecting electrodes and repelled by the discharge electrodes. As a result of the forces generated, the dust particles and/or liquid droplets will collect on the electrodes, primarily the collecting electrodes.

BACKGROUND PRIOR ART

Various types of electrostatic precipitators are known to the art, of which the construction of the respective precipitator is adapted to the nature of the contaminants to be separated, the concentration of the contaminant and the amounts in which it is present.

For example, there is known to the art an electrostatic dust precipitator in which the collecting electrodes hang freely from a beam system and in which the electrodes are shaken when the dust has collected to a given thickness thereon, by subjecting the lower parts of the electrodes mechanically to an impact force, so-called cleansing percussion, thereby causing the dust particles to relinquish their hold on the collecting electrodes and to fall gravitationally therefrom.

Such electrostatic precipitators utilize dry collecting electrodes.

Also known to the art are electrostatic precipitators in which a liquid film is caused to pass along the external surfaces of the collecting electrodes. The dust and like solids separated from the through-flowing gas is attracted to and absorbed by the liquid and leaves the precipitator together with the liquid, through an outlet provided herefor under the precipitator.

Such electrostatic precipitators utilize wet collecting electrodes.

SUMMARY OF THE INVENTION

TECHNICAL PROBLEMS

Normally, electrostatic precipitators of the aforesaid kind have the form of large units which are dimensioned to separate large quantities of dust per unit of time. Consequently, a technical problem resides in the construction of an efficient electrostatic precipitator of relatively small dimensions.

It will also be seen that a further technical problem resides in the construction of an efficient electrostatic precipitator of relatively small dimensions without resorting to the conventional frame structure around which known precipitators are constructed, such frame structures being necessarily of large dimensions.

Another technical problem in this regard resides in the ability to construct an electrostatic precipitator which does not require the previously necessary outer precipitator frame structure, or with which the frame construction can be greatly simplified, by transferring the function of the flexurally rigid structural components primarily to the collecting electrodes.

A further problem exists in constructing an electrostatic precipitator which will be self-supporting in its entirety, even when incorporating collecting electrodes which are both flexurally rigid and light in weight, and/or electrodes embodied in a simple framework.

Another technical problem resides in the provision of collecting electrodes of such construction and in such orientation as to enable said electrodes alone to form the rigidifying structural components of the complete electrostatic precipitator.

It will be seen that a further technical problem resides in the construction of an electrostatic precipitator where the external dimensions thereof enable the precipitator to form or to be placed adjacent to a wall-section of a closed space adapted for paint-spraying purposes, such as the paint-spraying of motor-vehicle coachwork, e.g. a so-called spray booth to which the precipitator, or separator, can be connected with the aid of simple means, for the purpose of removing to some extent paint particles but primarily liquid droplets from air exiting from the spray booth.

It will also be seen that a further technical problem resides in the construction of an electrostatic precipitator adjacent an existing spray booth with the aid of simple means, and of providing conditions which will enable a precipitator, or separator, of sufficient efficiency to be constructed in the space available.

In this latter regard a problem resides in the possibility of constructing an electrostatic precipitator from readily assembled prefabricated parts, preferably standardized parts.

A further problem in this regard is one of constructing a combined electrostatic precipitator and paint booth in which a precipitator wall-section is able to form a wall-section of the spray booth.

It will also be seen that a technical problem resides in the construction of an electrostatic precipitator in which one or more, preferably all, collecting electrodes may comprise one or more flexurally rigid structural elements, by constructing each collecting electrode from an inner, flexurally rigid frame construction and by attaching thereto thin electrically-conductive plates which are not intrinsically resistant to bending, i.e. which are intrinsically flexible, It will be seen that in order to obtain a frame construction which is intrinsically resistant to bending but nevertheless light in weight, a further technical problem resides in providing a collecting electrode frame-construction which can be used in an electrostatic precipitator and which is capable of withstanding sub-pressures and of contributing to the overall stability of the precipitator and yet which still may comprise thin plates which face a space through which gasborne dust particles are intended to pass.

Another technical problem resides in the construction of an electrostatic precipitator in which the supporting structural elements consist substantially solely of the collecting electrodes and in which said electrodes form mutually opposing wall-sections, normally serving as partition walls, where the remaining opposing wall sections may be constructed from a flexible thin material, preferably an electrically conductive material. These latter wall sections shall be capable of being held in position substantially solely through the holding effect of subpressure generated in the aforesaid space.

A further technical problem is one of constructing with simple means a flexurally rigid collecting electrode which has planar external surfaces and which can be used in electrostatic precipitators which operate according to the wet-separation method and with which the whole filter section can be readily fitted to and dismantled from the precipitator.

Still another technical problem will be seen to exist in the provision of conditions which will enable a complete electrostatic precipitator to be constructed from a plurality of simple beam-like elements intended for detachably holding flexurally rigid collecting electrodes.

A further technical problem is one of constructing in a spray booth a simple electrostatic precipitator operating according to the wet separation method from standard parts, and to create conditions for recovering contaminated liquid from both the spray booth and the precipitator, so as to decontaminate the liquid.

SOLUTION

The present invention relates to an electrostatic precipitator of the kind which comprises discharge electrodes and collecting electrodes which are orientated in mutually adjacent relationship and which are supplied with a d.c. current of high voltage from a voltage source, such as to generate in the space between the electrodes an electrostatic field in which gasborne particles and/or liquid droplets entering the space are electrically charged so as to be attracted primarily to the collecting electrodes.

The inventive electrostatic precipitator is mainly characterized in that at least a multiple of the collecting electrodes present, and then at least two, are formed and positioned in a manner such that they form a self-supporting construction which is flexurally rigid in all directions; in that each of the flexurally rigid electrodes form a flexurally rigid wall section; and in that two such flexurally rigid wall sections are arranged to co-act with two further wall sections to form a space for accommodating one or more discharge electrodes.

Alternatively, all collecting electrodes may each comprise a flexurally rigid element. According to one advantageous embodiment each collecting electrode may comprise an internal, flexurally rigid frame-structure having attached thereto thin, flat electrically-conductive plates which are not themselves flexurally rigid.

In accordance with one advantageous embodiment of the invention, the discharge-electrode accommodating space is defined by one or more flexible wall-sections that are supported by respective upper and lower channel sections and which are held in abutment with the edge portions of at least two discharge electrodes through the agency of a subpressure created in said space.

Advantageously, the collecting electrodes are supported by at least two, preferably four, flexurally rigid beams, which also cooperate with the aforesaid flexible wall sections.

It is suggested in this regard that the beams and collecting electrodes are provided with respective first and second mutually co-acting readily detachable fastener devices.

According to a further advantageous embodiment of the invention all of the surfaces defining the discharge-electrode accommodating space are adapted to function as a collecting electrode.

ADVANTAGES

The advantages primarily afforded by an electrostatic precipitator constructed in accordance with the invention reside in the provision of conditions which enable a fully self-supporting electrostatic precipitator to be constructed readily from flexurally rigid collecting electrodes and simple, flexible wall-sections, i.e. wall sections which are not intrinsically resistant to bending. Because the individual components can be readily manufactured and may conveniently have standard measurements, provisions have been created for producing an inexpensive electrostatic precipitator which will function in accordance with the wet separation method.

BRIEF DESCRIPTION OF THE DRAWINGS

Exemplifying embodiments at present preferred and having significant inventive features will now be described in more detail with reference to the accompanying drawings, in which

FIG. 2 is a horizontal, sectional view of the electrostatic precipitator illustrated in FIG. 1;

FIG. 3 is a vertical sectional view of the electrostatic precipitator illustrated in FIG. 1;

FIG. 4 is a perspective view, partly in section, of the lower part of a collecting electrode constructed in accordance with the invention and capable of being used in all of the illustrated embodiments of the inventive electrostatic precipitator;

DESCRIPTION OF EMBODIMENTS AT PRESENT PREFERRED

Figure 1:
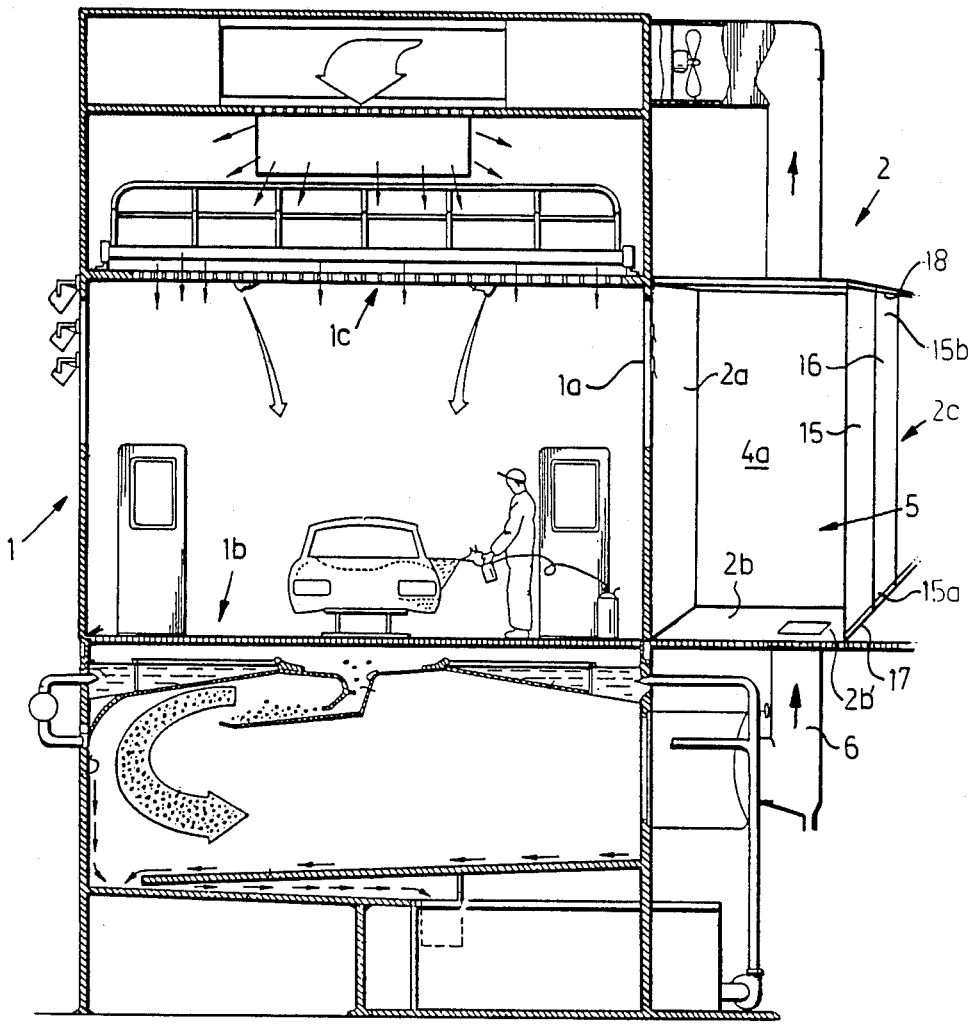
FIG. 1 is a perspective, greatly simplified view of a spray booth and a first embodiment of an electrostatic precipitator according to the invention.

FIG. 1 is a greatly simplified, perspective view of a conventional spray booth 1 intended, for example, for paint-spraying the coachwork of automotive vehicles.

Since neither the spray booth per se nor its intended use constitute any part of the present invention, they will not be described in detail here.

It is assumed that a gas flow containing paint and solvent is caused to exit from the spray booth through a compartment located beneath the floor of the booth, and that clean gas (air) is caused to flow into the booth from an overhead air delivery system.

The present invention affords the possibility of enabling a free-standing electrostatic precipitator 2 to be placed immediately adjacent the spray booth 1 in the manner illustrated, where the booth and precipitator are separated by a common partition wall that forms one end wall 1*a* of the booth and the "adjacent" end wall 2*a* of the precipitator.

It will be understood, however, that the end wall 1*a* of the booth and the adjacent end wall 2*a* of the precipitator may be spaced from one another so as to provide an entrance therebetween for service personnel.

It is normal in a plant of the kind illustrated in FIG. 1 to pass fresh air into the booth through the upper part 1*c* thereof and to allow air containing paint particles to exit from the booth through an exhaust system in the floor 1*b* thereof.

The particle-laden air-flow passing through the bottom or floor 1*b* of the booth cleansed in liquid, normally water, is introduced into the electrostatic precipitator 2, through apertures 2*b'* located in the floor 2*b* thereof.

FIGS. 2 and 3 illustrate in more detail a first exemplifying embodiment of the electrostatic precipitator 2 illustrated in FIG. 1. As shown in these Figures the precipitator in this case comprises rows of discharge electrodes, of which rows two have been referenced 3, 3*a*, and a plurality of mutually identical collecting electrodes, of which mutually adjacent electrodes have been referenced 4, 4*a*. It will be seen from FIG. 2 that the rows of discharge electrodes 3, 3*a* are located in mutually parallel spaced relationship. The collecting electrodes 4, 4*a* form opposing flexurally rigid wall sections, which are normally used as partition walls and which define a space around the rows of discharge electrodes 3. This space is referenced 5 in the Figures and is delimited by two further opposing wall sections, which are in themselves not resistant to bending, i.e. are flexible.

All four wall sections defining the space 5 present at least one electrically conductive surface which faces towards the space. These surfaces are connected together electrically via earth connections.

A d.c. current of high voltage is applied to the electrodes 3, 3*a*, 4, 4*a* from a conventional voltage source (not shown), such as to generate in the space 5 located between the electrodes 3, 3*a*, 4, 4*a* and the wall sections 2*a* and 15 an electrostatic field which imparts an electric charge to the solid particles and/or the liquid droplets carried by a gas stream 6 entering said space, wherewith the electrically charged particles/droplets are attracted primarily to the collecting electrodes 4, 4*a* and the wall sections 2*a* and 15.

Since the voltage source used forms part of the known prior art, it has not been shown in the Figure It will be seen from FIGS. 2 and 3 that a complete electrostatic precipitator comprises rows of discharge electrodes 3, a plurality of collecting electrodes 4, 4*a*, and wall section which form a multiple of sections. The following description is made, however, solely with reference to one such section.

This section delimits the space 5 with two opposing wall sections, or partition walls, formed from the flexurally rigid collecting electrodes 4, 4*a*, and two opposing wall sections 2*a*, 15, which are formed from wall elements which are not intrinsically resistant to bending, i.e. are intrinsically flexible.

The present invention pertains to collecting electrodes which are of particular construction and of such orientation as to form a self-supporting structure. These electrodes can be used in both of the illustrative embodiments described here.

Accordingly, FIG. 4 illustrates in perspective and partly in section an embodiment of the collecting electrode 4*a* at present preferred. According to the invention one or more, preferably all, of the collecting electrodes incorporated in the electrostatic precipitator may be constructed from such flexurally rigid elements.

The illustrated collecting electrode 4*a* comprises a flexurally rigid internal frame-structure which includes two vertical, edge-stiffening bars or beams 8, 9 and a plurality of horizontally extending beams or bars 10, 11. Connected to each side of the resultant rigid frame structure 8, 9, 10, 11 are thin, intrinsically flexible flat plates 12, 13 which are made of an electrically conductive material. These plates may have a thickness of less than 1.0 mm, and are fastened to the frame structure with the aid of suitable welding, riveting, adhesive bonding or adhesive taping techniques.

The frame structure may alternatively be replaced with foam plastic or some corresponding material, to form a means of attachment for the plates 12, 13, or the frame may be replaced with corrugated filling material.

It will be understood that the frame structure may be comprised of lightmetal on a corresponding material.

In accordance with a first embodiment of the invention, each collecting electrode 4*a* is positioned against and held to an associated wall section 2*a* with the aid of channels provided on the wall section and spaced apart at a distance that corresponds to the desired distribution of the collecting electrodes.

It is proposed that corresponding channels are also formed in the bottom section 2*b*.

The edges of the electrode 4*a* have provided thereon rails which correspond to the aforesaid channels.

The illustrated wall section 2*a* and/or the illustrated wall section 2*c* may comprise a single-piece wall element, or may comprise a plurality of parts, the width of which will preferably conform with the distance between mutually adjacent discharge electrodes, or multiples thereof.

In the case of the illustrated embodiment a wall section 2*c* opposing the wall section 2*a* comprises a plurality of flexible parts 15, 16 which assist in defining, inter alia, the aforesaid space 5. Each of these wall sections, e.g. the wall section 15, engages in upper and lower, mutually identical channel-sections 18 and 17 which extend parallel with one another, with the openings of said channels facing towards each other.

Figure 5:
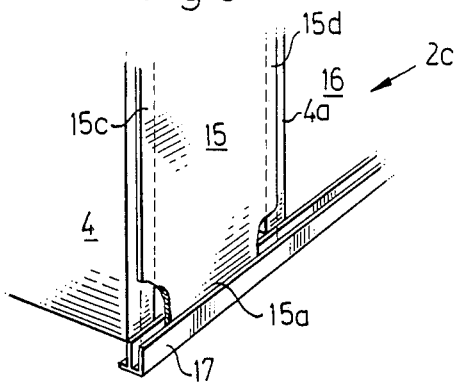
FIG. 5 is a view which illustrates a wall element intended for the precipitator illustrated in FIG. 1 and extending between two collecting electrodes, said wall section also being shown in engagement with a lower channel section.

FIG. 5 illustrates the bottom 15*a* of the wall section 15 in engagement with the lower channel section 17, it being assumed that the top 15*b* of the wall section engages in the opposing upper channel section 18. In order to fit the wall section 15 in position between the channel sections 17, 18, the wall section 15 is initially arched so as to enable the top and bottom edges thereof to enter the respective channel sections, and is then relaxed.

It is essential that the other mutually opposing edge-parts 15*c*, 15*d* of the wall section are in connection with a respective collecting electrode. To this end it is proposed in accordance with the invention that the edge parts 15*c* and 15*d* of the wall section 15 are held to and sealed against respective collecting electrodes 4 and 4*a* through the agency of a subpressure created in the space 5.

Figure 6:
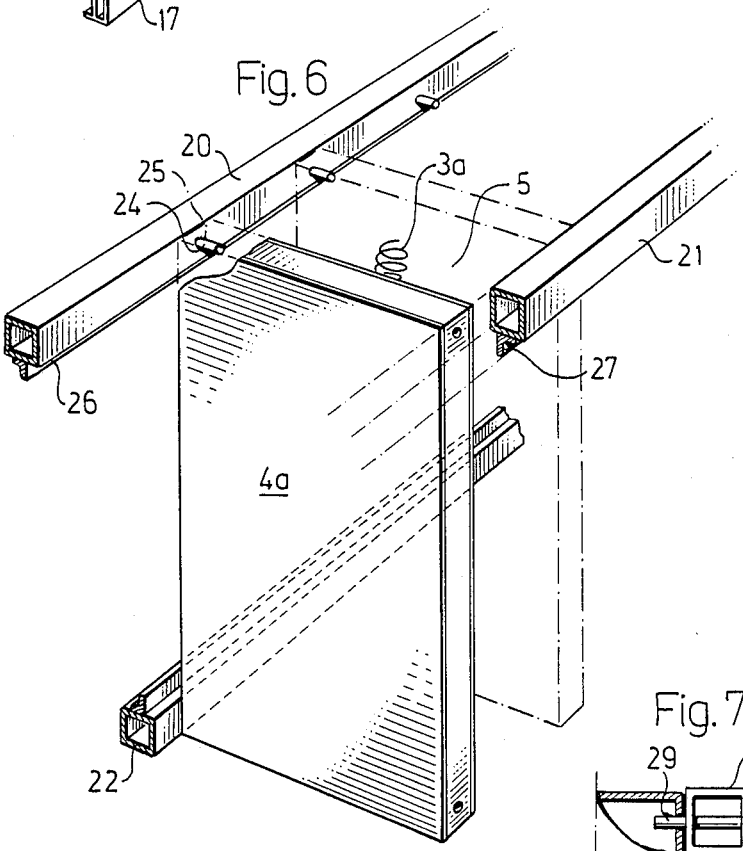
FIG. 6 is a schematic, greatly simplified view of a second embodiment of an electrostatic precipitator constructed in accordance with the invention.
Figure 7:
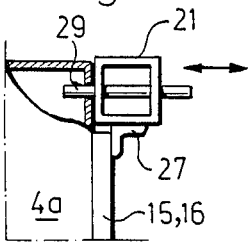
FIG. 7 illustrates schematically the mutual co-action between a collecting electrode, a channel section, and a flexurally rigid wall-section.

FIGS. 6 and 7 illustrate an electrostatic precipitator constructed in accordance with the invention and operating according to the wet separation method, and show a preferred embodiment of fastening means for securing electrodes to the precipitator.

This embodiment comprises four flexurally rigid beams, i.e. two upper beams 20, 21 and two lower beams, of which one, 22, is shown in chain lines. The manner in which the beams are held together has not been shown, for the sake of simplicity.

The beam 20 has arranged thereon a first fastener device 24 in the form of a peg, which is preferably resilient or supple so that it can be pressed or pushed to one side towards the face of the beam. The collecting electrode is provided with a second, corresponding fastener device in the form of a hole 25, the said fastener devices 24, 25 co-acting with one another to hold the collecting electrode to the beam 20.

It will be understood that each beam 20, 21, 22 has corresponding fastener devices which co-act with complementary fastener devices on the collecting electrode.

Each beam has attached thereto an angle iron, such as the angle iron 26 attached to the beam 20 and the angle iron 27 attached to the beam 21 of the FIG. 7 illustration.

The collecting electrodes 4*a* are dimensioned so that they lie sealingly against the beams and so that they will also sealingly cooperate with the wall sections 2*a* and 15, to form a closed space 5 around the discharge electrode 3.

It will be understood that the invention is not restricted to the described and illustrated embodiments, and that modifications can be made within the scope of the invention defined in the following claims.

What is claimed is:

1. An electrostatic precipitator comprising discharge electrodes and collecting electrodes arranged in mutually adjacent and spaced relationship, and a voltage source for supplying a high-voltage d.c. current to the electrodes so as to generate in a space therebetween an electrostatic field operative in electrically charging at least one of gasborne solid particles and liquid droplets entering said space, the charged particles and being attracted primarily to the collecting electrodes, wherein at least two of the collecting electrodes each include a self-supporting electrode structure which is flexurily rigid in all directions; and each of said flexurily rigid collecting electrodes form a flexurily rigid wall-section which together with two further wall-sections define a space for accommodating one or more discharge electrodes, each of the flexurily rigid electrodes comprising an internal, flexurily rigid frame construction having attached thereto thin, flexible flat plates made of an electrically conductive material.

2. An electrostatic precipitator according to claim 1, wherein all collecting electrodes of the precipitator have the form of a flexurily rigid structure.

3. An electrostatic precipitator according to claim 1, wherein the discharge electrode accommodating space of the precipitator is delimited by one or more flexible wall sections held by upper and lower channel sections oriented for co-action with an edge portion of at least two collecting electrodes by a subpressure generated in said space.

4. An electrostatic precipitator according to claim 1, wherein the collecting electrodes are held firmly by at least two flexurily rigid beams and in that flexible wall sections co-act with said beams.

5. An electrostatic precipitator according to claim 4, wherein said beams have first fastener means and the collecting electrodes have second fastener means, said first and second fastener means being arranged to detachably co-act lockingly with one another.

6. An electrostatic precipitator according to claim 1, wherein all surfaces defining the discharge electrode accommodating space function as a collecting electrode.

* * * * *